United States Patent [19]

Chalmers, II et al.

[11] 4,433,457

[45] Feb. 28, 1984

[54] BUCKLE, NOTABLY FOR SKI BOOTS

[75] Inventors: Edward L. Chalmers, II; David C. Everest, III, both of Boulder, Colo.

[73] Assignee: Lange International S.A., Fribourg, Switzerland

[21] Appl. No.: 374,650

[22] Filed: May 4, 1982

[51] Int. Cl.[3] ..... A43C 11/00

[52] U.S. Cl. ..... 24/68 SK; 24/71 SK; 24/69 SK

[58] Field of Search ..... 24/68 SK, 71 ST, 71 SK, 24/71 J, 69 SK, 69 ST, 69 J

[56] References Cited

U.S. PATENT DOCUMENTS 4,051,611 10/1977 Chalmers ..... 24/68 SK

*Primary Examiner*—Robert Peshock

*Attorney, Agent, or Firm*—Robert E. Burns; Emmanuel J. Lobato; Bruce L. Adams

[57] ABSTRACT

This fastener for closing two opposed closure flaps of a sports footwear, notably a ski boot, comprises on a first flap of the footwear a coupling member adapted to interconnect these flaps, means for anchoring one end of the coupling member to a catch member secured to the one flap, a binding lever pivoted to a support fixed to the other flap of the footwear and having pivoted thereto the other end of the coupling member and comprising beyond its pivot point a rigid extension lying substantially within the plane and thickness of the binding lever extension for interlocking substantially in a common plane the end of the lever extension and the binding lever in their closed and fold-down position which is also the closed position of the fastener itself. The end of the extension is notched and has pivotally mounted therein a spring-loaded pawl formed with teeth cooperating with corresponding teeth formed in the bottom of this notch on the binding lever, so that when closed the device can be opened by actuating a small auxiliary lever or depressing an arm with the thumb.

11 Claims, 8 Drawing Figures

BUCKLE, NOTABLY FOR SKI BOOTS

FIELD OF THE INVENTION

The present invention relates to a buckle or fastener for closing two opposed flaps of a sports-boot, notably a ski boot, adapted to exert a traction on these two flaps and thus tightly belt the boot about the user's foot, the buckle comprising for this purpose a tightener pivoted to one portion of the boot and pivotally connected to a coupling and traction element. However, the device of the present invention is based on a principle differing from the conventional over-center or knee-joint principle, that is, the non-alignment of the fulcrum and anchoring points.

DESCRIPTION OF THE PRIOR ART

The devices utilized up to now for closing ski boots, which are commonly referred to as buckles, are subjected to relatively high tensions. To be kept reliably in its closed position, the tightening lever of these buckles must be tensioned by a tractive force transmitted through the medium of a support definitely spaced from the fulcrum point about which the buckle is pivoted to the boot. A recent form of embodiment of a buckle of this type is disclosed in the U.S. Pat. No. 4,051,611. In order to preserve the above-disclosed closing conditions the fulcrum of the tightening lever on the boot must be relatively spaced from the boot, especially if the curvature formed by the two flaps of the boot to be tightened together is relatively moderate. Moreover, in certain boots the mounting positions of these buckles are such that the boot contour is so flat that it is hardly possible to keep the buckle closed unless the fulcrum of the tightening lever is spaced away from the boot to a hardly acceptable degree. As a rule, the buckles manufactured according to a now popular principle are compulsorily relatively thick, so that they project unduly or more or less excessively from the boot surface. This excessive projection is attended by several inconveniences. Thus, notably when the ski boot is intended for downhill races, this projection is liable to interfere with the boot streamline. In other cases it is likely to hit or catch the poles marking the lateral limits of a race course. Furthermore, when skiing or in a fall, the buckle is obviously likely to hit an obstacle or to be damaged. Finally, the importance of aesthetics in the case of a ski boot cannot be disregarded.

In the German Utility Model DE 80 02 933 a solution has been proposed for keeping a buckle in its closed position. In this device, the tightening lever is formed with a row of notches for engagement by the buckle and comprises at its end a small hook adapted to engage one notch of the tension lever support. However, to be efficient this auxiliary hook requires that the boot portion to which the tension lever support is mounted should have a well-defined curvature. Therefore, a specific buckle must be manufactured which has a curvature matching each boot curvature, and this obviously is far from constituting a rational solution. Moreover, this auxiliary hook projects very markedly from the ski surface.

SUMMARY OF THE INVENTION

The present invention provides an improved device for closing the two opposed portions of a sports boot which avoids the above-mentioned inconveniences. The device of this invention is held in its closed position without adhering to the principle of non-alignment of the fulcrum and anchoring points. This device is particularly flat and has a moderate height. It is capable of adapting itself automatically to the various curvatures of the boots to be equipped therewith. Moreover, this device can be fitted to particularly flat boot portions. Contrary to actual practice, when the principle of non-alignment of pivot points or centers is adhered to in all cases, with the device of the invention it is not at all necessary to over-center the pivoting arm.

According to a specific feature characterizing the present invention, a fastener for sports footwears and more particularly for ski boots comprises a substantially non-extensible coupling member adapted to interconnect the two opposed portions or flaps of the footwear or boot, means for anchoring one end of said coupling member to a catch member fixed to one of said opposed boot portions, a latch or binding lever pivoted to a support fixed to the other portion of the boot and having pivoted thereto the other end of said coupling member and comprising beyond its pivot point a rigid extension substantially within the plane and thickness of said binding lever in the closed and depressed position thereof, cooperating locking means on said binding lever and said extension for interlocking substantially in a common plane the end of said extension and said binding lever in the closed and depressed position thereof, that is, in the closed position of the fastener.

In a specific form of embodiment of the invention the locking means consist of a pawl pivoted to the end of said binding arm lever and adapted to engage spur teeth formed on the end of said coupling member extension. This pawl can be released either by actuating a small auxiliary lever or simply depressing an arm on the pawl with the thumb.

In another modified form of embodiment of the device of this invention the locking means consists of a transverse pin slidably mounted in the binding lever and engageable in a notch formed in the end of said coupling member extension.

It will be seen that the primary feature characterizing this invention consists in interlocking the binding lever and the coupling member consisting either of a buckle, or of a strap provided with hook means adapted to be engaged by a buckle attached to the other portion of the boot. As a rule, the coupling member may be of any suitable type, simple or complex, adjustable or not. On the other hand the binding lever may comprise either two arms between which the coupling member is pivotally mounted or, inversely, a single arm engaging the forked end of the coupling member. This proves that many modified versions of the coupling member, anchoring point and binding lever configuration may be contemplated within the scope of the invention.

A clearer understanding of the invention will be had as the following description of a few preferred forms of embodiment thereof proceeds with reference to the accompanying drawings.

DETAILED DESCRIPTION OF THE PREFERRED EMBODIMENTS

Figure 1:
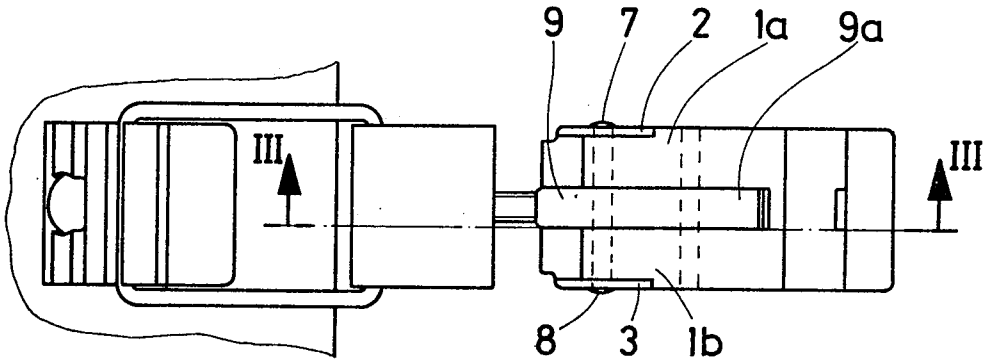
FIG. 1 is a plan view from above of a first form of embodiment of a quick-release buckle device according to the present invention.

Reference will be made firstly to FIGS. 1 to 4 of the drawings. The buckle for sports footwears and notably ski boots illustrated therein comprises a latch or binding lever 1 in the form of a slightly curved plate formed with a central slot providing a pair of parallel side arms 1*a* and 1*b* pivotally connected to a pair of lugs 2 and 3 formed integrally with a support 4 consisting of a metal plate from which the lugs 2 and 3 project at right angles, said plate 4 being fastened to one of the flaps 5 of the boot (shown in cross-section) by means of at least one rivet 6. The binding lever 1 is pivoted to the lugs 2 and 3 by means of a pair of riveted pins 7 and 8. A pull bar 9 is pivoted in turn by means of a pivot pin 10 to the binding lever 1, between the arms 1*a* and 1*b* thereof, the pivot pin 10 being riveted in turn to the binding lever 1. The pull bar 9 has a screw-threaded extension 11 having an intermediate plate 12 screwed thereon; this plate 12 acts as a wireform holder and is in fact pivotally connected to a rectangular wireform 13 adapted to engage one of the notches or teeth 14 of a rack 15 secured by rivet means 16 to the other flap 17 of the ski boot or other footwear. All the component elements of the device are made from a suitable metal or alloy. The pull bar 9 comprises beyond its fulcrum 10 an extension 9*a* disposed between said side arms 1*a* and 1*b* and parallel to, and within the thickness limits of the binding lever 1, in the fold-down or closed position illustrated in FIGS. 1 to 3. Surrounding pivot pin 10 is the coiled portion of a compass spring 18 bearing with its bent legs on the one hand against the aforesaid extension 9*a* and on the other hand against the binding lever 1 so as to constantly and resiliently urge the binding lever 1 and pull bar 9 in the fold-down position shown in FIGS. 2 and 3. The outer end of this extension 9*a* is provided with transverse horizontal teeth 19. Registering with said teeth 19 is a pawl 21 pivoted to a pin 22 and movable in a cavity 20 formed in said binding lever 1. The pawl 21 has the same width as pull bar 9. About the pin 22 is the coiled portion of another compass spring 23 constantly and resiliently urging the nose of pawl 21 for engagement with the teeth 19. One arm 21*a* of this pawl 21 extends under the end of binding lever 1 into a cavity thereof. Pivoted about a pin 25 to the end of binding lever 1 is a small auxiliary lever 24 having a lip 24*a* disposed between the arm 21*a* of pawl 21 and the binding lever 1, so that said auxiliary lever 24 is constantly urged by the pawl compass spring 23 to the position shown in the drawing. The auxiliary lever 24 has notches or grooves 26 formed in its lower or inner face to facilitate its slipless actuation by the user's finger or glove.

Figure 2:
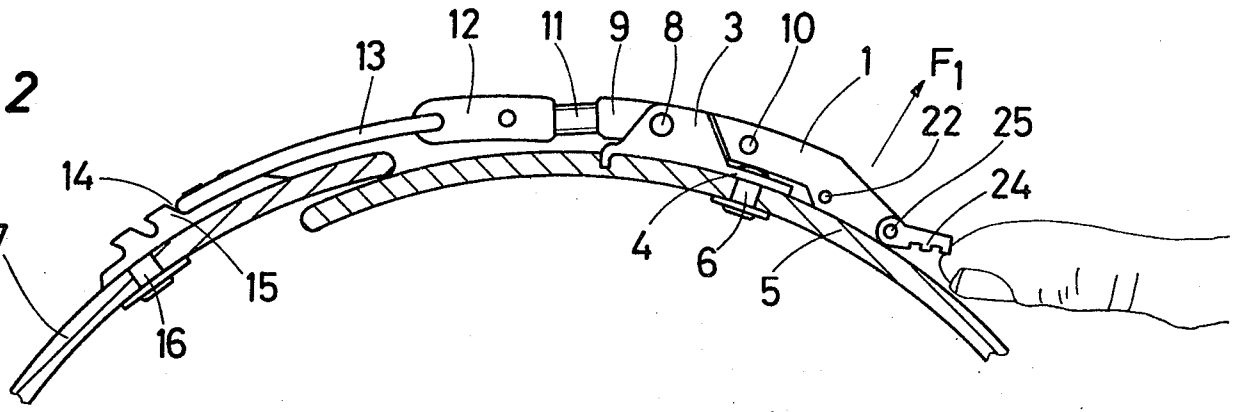
FIG. 2 is a side elevational view of the device of FIG. 1, shown in its closed position.
Figure 4:
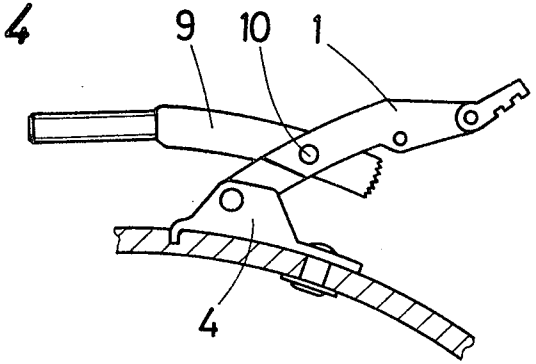
FIG. 4 illustrates the same device in its open position.
Figure 3:
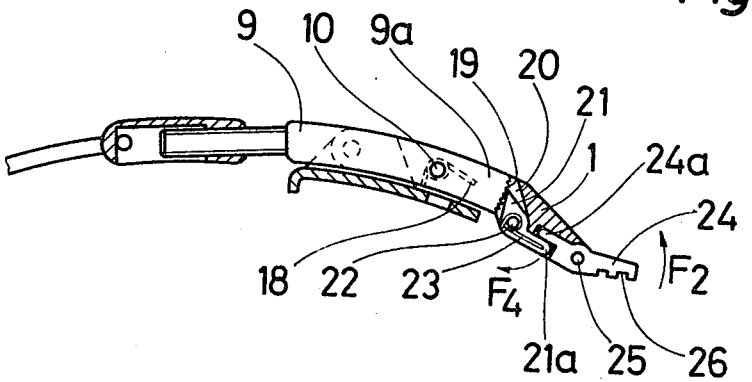
FIG. 3 is a fragmentary section taken along the line III—III of FIG. 1.

The above described device operates as follows: in the position shown in FIGS. 2 and 3, the nose of pawl 21 engages one of the teeth 19. Any force tending to lift the binding lever 1 in the direction of the arrow F1 (for instance a component of the tractive force exerted on pull bar 9 as a consequence of an elastic distortion of the boot which causes the fulcrum 10 to be moved temporarily to a position overlying the straight line interconnecting the anchoring notch of wireform 13 on rack 14 and pivot pin 8) tends to engage the pawl 21 more deeply into the teeth 19. Since the pawl cannot rotate, the pull bar 9 and binding lever 1 are locked in the position illustrated. To open or release the buckle or fastener, the user simply inserts the end of one finger under the auxiliary lever 24 to raise same as illustrated in FIG. 2. Since the compass spring 23 is relatively weak, only a very moderate effort is sufficient for actuating this lever 24. As a consequence of the tilting of auxiliary lever 24 in the direction of the arrow F2 (FIG. 3), the pawl 21 will pivot in the direction of the arrow F4. Thus, the pawl 21 will move away from teeth 19 and engage the top wall of its cavity 20 so as to free the pull bar 9. Then the user may lift the pull bar 1 to the open position shown in FIG. 4, and the wireform 13 can eventually be released in the known fashion.

To reclose or reset the device, the user, after engaging the wireform 13 into the selected notch of rack 15, depresses the binding lever toward the boot. During this last-mentioned movement the pawl 21 slides on the teeth 19 and then engages one of these teeth, thus interlocking again the binding lever 1 and pull bar 9. Stress may be laid on the fact that the binding lever 1 may in all cases be folded down completely and that the pawl 21 assumes automatically a proper locking position.

Figure 5:
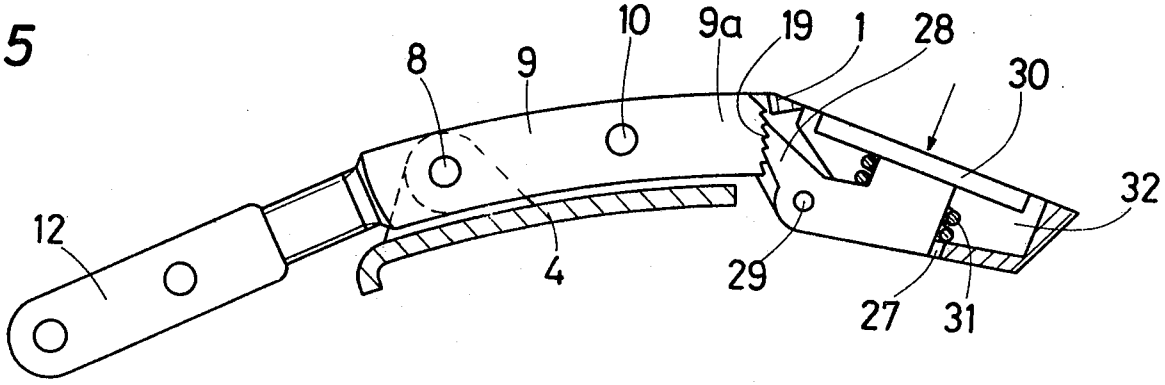
FIG. 5 illustrates in fragmentary side elevational view a second form of embodiment of the buckle device.

Many modifications and changes may be brought to this first form of embodiment. One of them is illustrated in the fragmentary side elevational view of FIG. 5, which is similar to FIG. 3. The component elements corresponding to those of the first form of embodiment are designated by the same reference numerals. In this modified version, the slot formed between the lateral arms 1*a* and 1*b* of binding lever 1 is prolonged towards the rear end of the device to constitute a slot 27 in which a pawl 28 is pivotally mounted about a pin 29. This pawl 28 comprises an arm widening out to form a rectangular push-button 30 substantially flush with the top surface of the bent end portion of binding lever 1. Underlying this push-button 30 is a cavity 32 allowing the push-button 30 to be depressed inside the binding lever 1. The nose of pawl 28 is also toothed, that is, provided with teeth corresponding to those 19 formed on the registering end of the pull bar extension 9*a*, so as to properly distribute the stress on the pawl nose. This pawl 28 is resiliently urged to the position illustrated either by means of a two-armed compass spring (not shown) as in the first form of embodiment, or by means of a helical coil compression spring 31 disposed between the push button 30 and the bottom of cavity 32. If desired, a simple rubber block may be substituted for the spring 31. The mode of operation of this modified form of embodiment is the same as that of the first form of embodiment, except that the user is required to depress with his thumb the push-button 30 while raising the binding lever 1 with one or two fingers.

Figure 6:
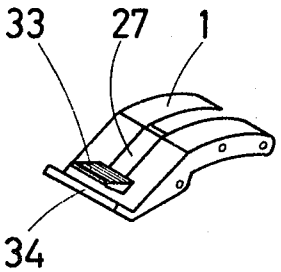
FIG. 6 illustrates a modified version of this second form of embodiment.

FIG. 6 illustrates a modified form of embodiment in which the push button 30 is eliminated and changed to a widened knurled end portion 33 extending parallel to a bent lip 34 of binding lever 1. To release and lift the binding lever 1 the user simply grasps these elements 33 and 34 between finger and thumb.

Figure 7:
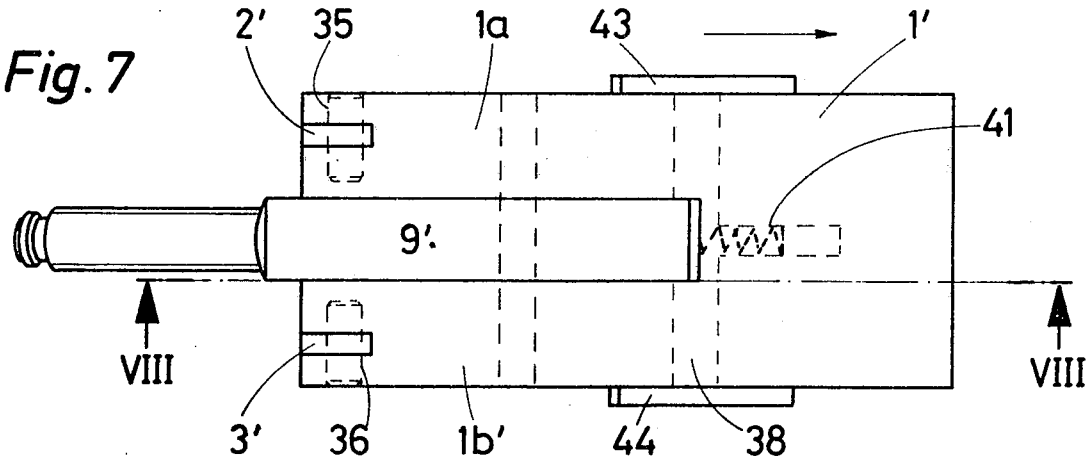
FIG. 7 is a fragmentary plane view of a third form of embodiment.
Figure 8:
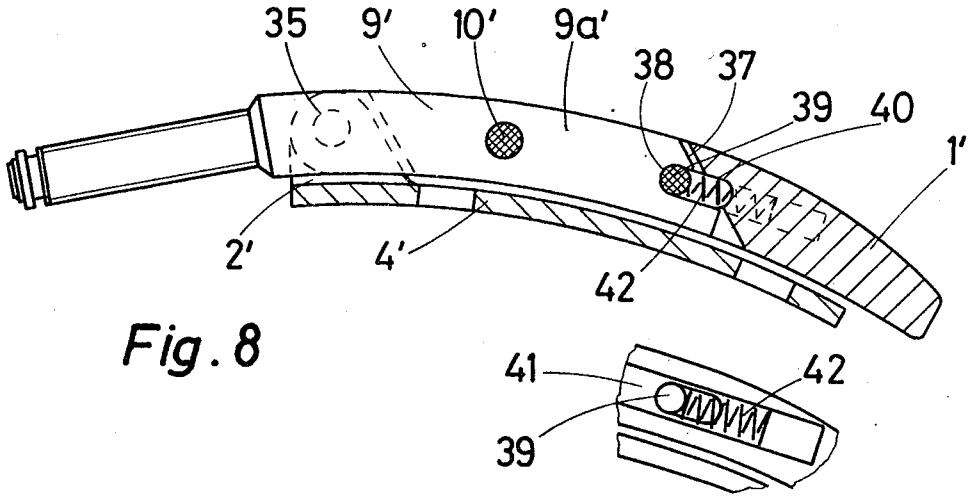
FIG. 8 is a section taken along the line VIII—VIII of FIG. 7.

Another type of locking device according to this invention is found in the third form of embodiment illustrated only partially in FIGS. 7 and 8 showing the binding lever and pull bar assembly. The other component elements are identical with those of the preceding forms of embodiment. The binding lever 1' comprises likewise a pair of side arms 1a' and 1b' pivotally connected to a plate 4' provided with upstanding lugs 2' and 3' engaging a pair of corresponding slots formed in the end portion of each arm 1a' and 1b', by means of a pair of trunnions 35 and 36 driven in corresponding holes formed in said arms. A pull bar 9' is pivoted to the binding lever 1' about a pin 10' and comprises an extension 9a' beyond its fulcrum 10'. The end of this extension has a bevelled face 37 in which a horizontal notch 38 is formed. This notch 38 is engaged by a cross pin 39 extending through and through the binding lever 1' in a passage 40 of elongated or oval cross-sectional contour parallel to said binding lever and allowing the movement of cross pin 39 from one end to the opposite end of this counter 40. A blind hole 41 is formed in binding lever 1', in co-planar relationship with said contour 40, and this blind hole 41 encloses a coil compression spring 42 constantly biasing the pull bar 39 to the bottom of said notch 38. The side ends of cross pin 39 protrude from the sides of binding lever 1' and are rigid with a pair of preferably ribbed plates 43 and 44 enabling the user to move the cross pin 39 in the direction of the arrow for removing it from the notch 38 and thus permit the upward movement of binding lever 1'. When closing or locking the device the cross pin 39 is caused to slide on the bevelled surface 37 and thus compress spring 42, whereafter it drops automatically back to the locking position illustrated in the drawing.

It may also be pointed out that the improvement brought by the present invention relates only to the locking of the binding lever and pull bar in their closed position. Therefore, in addition to the many modifications that can be brought to the locking device within the scope of this invention, the basic principles thereof are applicable to all possible forms of embodiment of such binding lever and of the pull member pivotally connected to this lever. This pull member may notably comprise either only one or several component elements; it may comprise a buckle or wireform, as illustrated, or a rack engageable by a buckle or wireform pivoted to the other element of the boot.

On the other hand, the binding lever may if desired comprise more than two arms, or a single arm; the coupling member itself may comprise a forked end, the binding lever being pivoted between the two arms of the fork. In this case, the locking action may be obtained for example as in the third form of embodiment shown in FIGS. 7 and 8 of the drawings or the fork shaped end of the coupling member could be caught by a pawl fitted on the outside of the lever.

What is claimed is:

1. A device for closing two opposed closure flaps of a sports footwear, notably a ski boot, which comprises:

a fastening element adapted to be secured to one of the closure flaps, a coupling member for interconnecting said two flaps, means for connecting said coupling member with said fastening element, a latch lever pivotally connected at one end to a support adapted to be secured to the other of said closure flaps, means pivotally connecting said coupling member with said latch lever, said coupling member having an integral extension which extends beyond the pivotal connection of said coupling member with said latch lever substantially in co-planar relation and within the thickness of said latch lever when said latch lever is pivoted to its closed position adjacent said other flap, cooperating means on said extension and said latch lever for locking said extension and latch lever in closed position, and means for releasing said locking means.

2. The device of claim 1, wherein said latch lever comprises two side arms pivotally mounted on two lugs projecting from said support, said coupling member being pivotally mounted in turn in the gap formed between said lugs, said extension of said coupling member being also disposed in said gap, said locking means consisting of a pawl pivotally mounted on said latch lever and adapted to cooperate with teeth formed on the transverse end face of said extension, and biasing means constantly urging said pawl for engagement with said teeth, said pawl being normally oriented towards the top surface of said extension so as to counteract the opening of the device, and said releasing means comprising means for releasing said pawl from said teeth to permit the opening of the device.

3. The device of claim 2, wherein said pawl biasing means consists of a compass-spring mounted about the pawl pivot pin, and said pawl releasing means consists of an auxiliary arm pivoted to the end of said latch lever and provided with a finger bearing against one arm of said pawl which is opposed to the end thereof engaged in said teeth, under the end of said latch lever.

4. The device of claim 2, wherein said pawl comprises at its tooth-engaging end a control arm extending through said latch lever to allow its direct actuation by the user.

5. The device of claim 4, wherein said pawl control arm has an end portion widening out constituting a convenient push button housed in a cavity of said latch lever and flush with the top surface of said latch lever.

6. The device of claim 5, wherein said pawl biasing means consists of a resilient element compression stressed between said push-button forming widened end of said pawl control arm and the bottom of said cavity in said latch lever.

7. The device of claim 4, wherein said pawl control arm is disposed between the two arms of said latch lever and has an end portion widening out and projecting above the end of said latch lever, to allow the pawl release by the user grasping simultaneously said bent lip and said widened pawl control arm.

8. The device of claim 1, wherein said latch lever comprises two lateral arms pivoted to a pair of lugs, respectively, of said support and between which said coupling member is pivotally connected and said extension of said coupling member is engaged, and wherein said locking means comprises a cross pin disposed within the thickness of said latch lever through a hole having an elongated cross-sectional contour permitting the movement of said cross pin in the longitudinal direction of said latch lever, said cross pin protruding from both sides of said latch lever to allow its manual actuation, the front end of said coupling member extension having formed therein a notch of which the bottom is substantially coincident with the end of said elongated contour which is opposite the latch lever end, said notch being engageable by said cross pin responsive to biasing means housed in said latch lever.

9. A device for closing two opposed closure flaps of a sports footwear, which comprises:

a buckle-forming metal wireform pivoted to an element adapted to be secured to one of said closure flaps;

a rack adapted to be secured to the other closure flaps for engagement by said wireform;

a latch lever pivoted to a support secured to one of said flaps and having pivotally mounted thereon a pull bar to which said wireform is pivotally connected, said pull bar comprising an extension beyond said pivotal connection, substantially in the plane and within the thickness of said binding lever when the device is closed;

cooperating locking means mounted to said latch lever and pull bar extension for interlocking substantially in a same plane said extension and said latch lever in the fold-down, closed position of said binding lever, and means for releasing said locking means.

10. A sports footwear comprising two flaps to be interconnected by at least one closing device for interconnecting said flaps, wherein said closing device comprises:

a non-extensible coupling member adapted to interconnect the two flaps of the footwear;

means for connecting a first end of said coupling member to a fastening element adapted to be fixed in turn to one of said flaps;

a latch lever pivoted to a support adapted to be fixed to the other flap of said footwear, means pivotally connecting said coupling member with said latch member, said coupling member having a rigid extension beyond its pivotal connection, substantially in the plane and within the thickness of said latch lever in the closed position thereof;

cooperating locking means on said latch lever and said extension for interlocking substantially in a common plane the end of said extension and said latch lever in the closed, fold-down position of said latch lever, that is, in the closed position of the closing device, and means for releasing said locking means.

11. A sports footwear comprising two flaps adapted to be interconnected and at least one closing device for interconnecting said flaps, wherein said device comprises:

at least one hook means fixed to one of said flaps, a rigid pull bar pivotally connected at one end to a wireform adapted to engage said hook means, a latch lever pivotally connected at one end to a support adapted to be secured to the other of said flaps, means pivotally connecting said pull bar with said latch lever, said pull bar having a rigid extension beyond its pivot point on said latch lever, said extension being substantially parallel to said latch lever and within the thickness thereof, in the closed folded-down position of said latch lever, cooperating means on said latch lever and extension for interlocking substantially in a common plane said extension and said latch lever in the closed folded-down position of said latch lever, and means for releasing said locking means.

* * * * *